US006035564A

United States Patent [19]

Cosmo et al.

[11] Patent Number: 6,035,564

[45] Date of Patent: Mar. 14, 2000

[54] IDENTIFICATION HOLDER

[75] Inventors: Patricia A. Cosmo, Charlotte; Douglas B. Harrison, Fremont, both of N.C.

[73] Assignee: Integrated ID Systems, Inc., Charlotte, N.C.

[21] Appl. No.: 09/146,609

[22] Filed: Sep. 3, 1998

[51] Int. Cl.[7] ..... A44C 3/00

[52] U.S. Cl. ..... 40/1.6; 40/661.04; 24/327; 24/3.11

[58] Field of Search ..... 40/652, 658, 647, 40/661.04, 664, 1.6, 1.5; 24/302, 327, 3.11

[56] References Cited

U.S. PATENT DOCUMENTS

| | | | |
|---|---|---|---|
| D. 271,986 | 12/1983 | Belser . | |
| D. 274,099 | 6/1984 | Belser . | |
| D. 314,015 | 1/1991 | Hickman, Sr. . | |
| 2,441,002 | 5/1948 | Berglund . | |
| 2,548,104 | 4/1951 | Frison | 40/1.6 |
| 3,648,392 | 3/1972 | Churchman . | |
| 4,361,934 | 12/1982 | Darmell | 24/302 |
| 4,707,906 | 11/1987 | Posey . | |
| 4,929,199 | 5/1990 | McKinnon | 439/759 |
| 4,961,275 | 10/1990 | Klein . | |
| 5,564,166 | 10/1996 | Roy . | |
| 5,592,767 | 1/1997 | Treske . | |

FOREIGN PATENT DOCUMENTS

| | | |
|---|---|---|
| 4226341 A1 | 2/1994 | Germany . |
| 2 219 272 | 12/1989 | United Kingdom . |

OTHER PUBLICATIONS

J.A.M. Plastics, Inc., catalog, Oct. 1, 1997, pp. 1–20.

*Primary Examiner*—Cassandra H. Davis
*Attorney, Agent, or Firm*—Alston & Bird LLP

[57] ABSTRACT

An identification holder is provided for securing a slotted identification badge and at least one pinned insignia to an item of clothing. The identification holder includes a base member defining a broad portion and an elongate portion depending therefrom. The elongate portion has a reduced width relative to the broad portion and is adapted to extend through the slot of an identification badge to thereby mount the identification badge to the elongate portion. A clip is provided for attaching the identification holder to an item of clothing. A pair of cooperating interlocking members are provided for securing the identification badge to the elongate portion. The broad portion of the base member defines at least one aperture therethrough adapted and arranged to receive the pin of an insignia whereby the insignia is positioned proximate to the identification badge for easy readability.

25 Claims, 2 Drawing Sheets

IDENTIFICATION HOLDER

FIELD OF THE INVENTION

The present invention relates to identification holders and more particularly, relates to personal holders for identification badges and insignias.

BACKGROUND OF THE INVENTION

With the growing need for security in the work place, many companies are providing their employees with identification badges or "IDs" that include the employee's picture and other important identifying information, such as the employee's name and employment position. Advances in computers and encoding technology have resulted in many companies creating IDs having magnetic or optically encoded strips for encoding such things as security passwords and company charge account information. The magnetic or optically encoded strips can be read by magnetic or optical sensing devices and the information obtained therefrom used to confirm authorization to enter secure areas or to credit and/or debit the employee's account for such expenses as meals at the company cafeteria. In many instances, employees are required to maintain the ID on his or her person while at work, and may even be required to display the ID while at work so that the photograph on the ID can be examined by security personnel.

It is also common practice for employers to provide the employees with pin-on badges or name tags, as well as decorations for distinguished service or to recognize specific occasions. These types of "pinned" insignia typically have an ornamental front and are secured by one of two means. First, the insignia may include a pin protruding from the back that cooperates with a hook clasp. To secure the insignia, the pin is pushed through an item of clothing at one point and then pushed back out at a separate point. Upon exiting the clothing, the pin is secured within the hook clasp, which prevents the insignia from becoming dislodged. Alternatively, the insignia may include a pin that is inserted through the item of clothing and is then prevented from exiting by a clasp that is attached to the end of the pin. In either case, inserting the pin through the item of clothing can permanently damage the wearer's clothing.

To facilitate the display of IDs, the employer may provide employees with a holder for securing the ID to the employee's clothing. Conventional ID holders typically include a clip that can be secured to a pocket or other part of the clothing. For example, U.S. Design Pat. Nos. 271,986 and 274,099 to Belser show a pocketed identification badge holder formed of a transparent material. The pockets are adapted to receive an ID therein. The ID holder is then secured to the wearer's clothing using a clip attached to the back of the ID holder. Alternatively, holes are provided in the ID holder for receiving a safety-pin which is inserted through the wearer's clothing to secure the ID holder. However, the use of a safety-pin to secure the ID holder to the wearer's clothing can create holes which can permanently damage business attire such as a wool suit or a silk blouse. Further, pocketed ID holders present certain problems in that holders of different sizes must be manufactured for IDs of different sizes, which can be costly, and the ID holder must of course be transparent. Additionally, inserting the IDs into the pockets can be difficult and may even result in tearing or separating of the pocket.

To eliminate the problems associated with pocketed ID holders, it has been proposed to use a flexible strap having cooperating snap members attached to opposed ends of the strap. The width of the strap is generally adapted to fit within a slot punched into an ID. To attach the ID to the ID holder, the strap is inserted into the slot and folded back onto itself at which time the snap members are snapped together. The strap and ID are then secured to the wearer's clothing using a clip attached to the back side of the strap.

To prevent damage to the clothing, the wearer can use a pin adaptor, as is known in the art, which includes thin member having one or more apertures therethrough for receiving the pin attached to the back of an insignia. The pin adaptor may be attached to the clothing using a clip. The insignia is then secured to the adaptor using a clasp. Because existing pin adaptors can be relatively prominent, these devices can be considered fashionably and aesthetically undesirable. Consequently, the wearer may choose not to use the adaptor, instead choosing to insert the pin into the wearer's clothing and risk damaging the clothing. Further, if the wearer is required to display an identification badge, it may not be feasible to wear both an ID holder and a pin adaptor. Even if both are worn, the pin adaptor is likely to be secondary in consideration to the ID holder and therefore, secured to the clothing in a location that is not as easily readable.

Thus, there is a need for improved ID holders. Such holders must be adaptable to different sizes of IDs, be securable to an item of clothing without damaging the clothing, and be capable of securing insignia in an easily readable location. Such a device would also preferably present a name tag and separate ID card for easy and efficient viewing by an observer.

SUMMARY OF THE INVENTION

The present invention meets these needs and others and provides an identification holder for securing both a slotted identification badge and at least one pinned insignia to an item of clothing. The identification holder includes a base member formed of a generally flat material defining a broad portion and an elongate portion depending therefrom. The elongate portion has a reduced width relative to the broad portion and is adapted to extend through the slot of an identification badge to thereby mount the identification badge to the elongate portion. The base member can have rounded corners. According to one embodiment, the outer perimeter of the base member is tapered where the broad portion transitions to the elongate portion. The base member can be formed of transparent or opaque materials. Preferably, the base member is formed of a flexible material, such as polyvinyl chloride.

A clip having first and second jaws is attached to the broad portion of the base member. Preferably, the clip is rotatably attached to the base member. According to one embodiment, the first and second jaws of the clip may be coated with vinyl to protect the item of clothing from damage.

A pair of cooperating interlocking members or snaps are provided. At least one of the interlocking members is attached to the distal end of the elongate portion and the other of the interlocking members is attached to the base member so as to cooperate and secure the identification badge to the elongate portion when the elongate portion is extended through the slotted identification badge and the interlocking members are fastened together. According to one embodiment, the interlocking member attached to the distal end of the elongate portion is a female snap member. In this embodiment, the other interlocking member attached to the base member is a male snap member.

The broad portion of the base member defines at least one aperture therethrough adapted and arranged to receive the pin of an insignia whereby the insignia is positioned proximate to the identification badge for easy readability. Advantageously, the broad portion of the base member defines an insignia-positioning space between the clip and the interlocking member secured to the base member such that the apertures defined by the base member are positioned proximate to the upper surface of the identification badge secured to the elongate member.

If the insignia is a conventional name tag, such as convention badge, two apertures are defined by the base member and horizontally spaced in the insignia-positioning space defined by the broad portion of the base member. Advantageously, the apertures are arranged such that the convention badge covers the snap members such that only a small portion of the lower end of the elongate member is exposed. This portion is enough to secure the ID just below the convention badge so that tidy, coherent presentation of the convention badge and ID is obtained.

Accordingly, there has been provided an identification badge holder that is adaptable to different sizes of IDs, that is securable to an item of clothing without damaging the clothing, and that is capable of securing an insignia in an easily readable location. Further, the identification badge of the present invention is capable of presenting a name tag and separate ID card in a coherent presentation for easy and efficient viewing by an observer.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
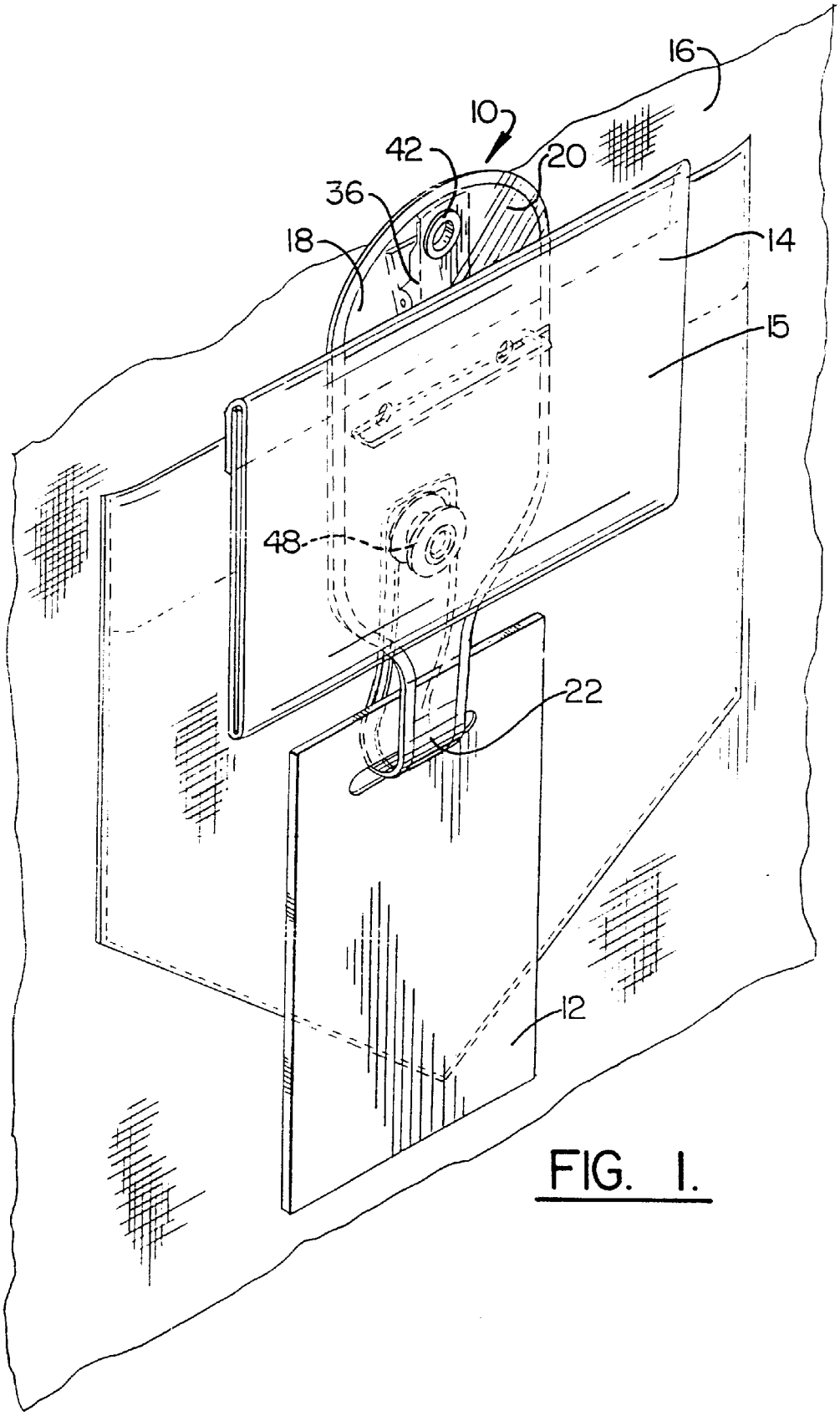
FIG. 1 is an environmental perspective view illustrating one embodiment of an identification holder according to the present invention attached to an item of clothing.
Figure 3:
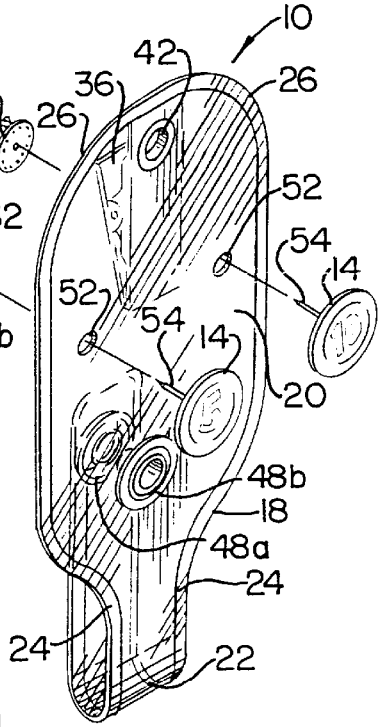
FIG. 3 is a perspective view illustrating the identification holder of FIG. 2 as seen from an opposite side.

Referring now to the drawings, and in particular to FIG. 1, there is shown an identification holder 10 for securing a slotted identification badge 12 and at least one clasped insignia 14 to an item of clothing 16. The identification badge 12 may include a photograph of the wearer, the wearer's name, position or rank, as well as a magnetic or optically encoded strip that is machine readable. The identification holder includes a base member 18 formed of a generally flat material defining a broad portion 20 and an elongate portion 22 depending therefrom. According to one preferred embodiment, as shown in FIG. 3, the outer perimeter 24 of the base member is tapered where the broad portion transitions to the elongate portion. The base member may have rounded corners 26 or square corners (not shown). Preferably, the base member is formed of a flexible material, such as polyvinyl chloride. In a preferred embodiment, the identification holder is formed of two sheets of heat-sealed 30 mil polyvinyl chloride. The base member can be transparent, translucent or opaque. Advantageously, the base member can be colored to designate a company's "colors" or even to distinguish between such things as personnel rank or position.

Figure 6:
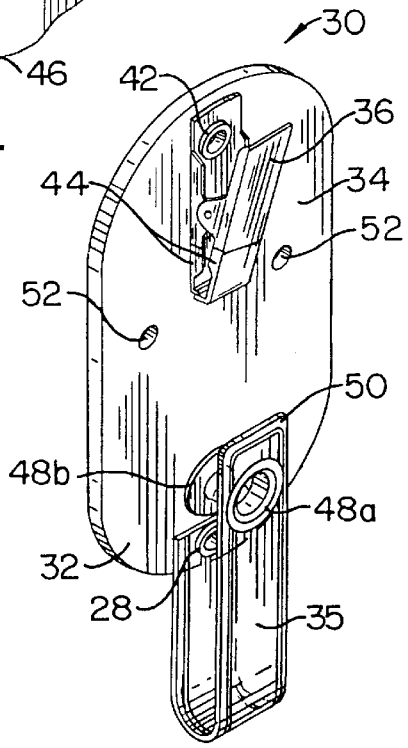
FIG. 6 is a perspective view illustrating an alternate embodiment of the identification holder with a rigid broad portion and a flexible elongate portion.

In another preferred embodiment, as shown in FIG. 6, the identification holder 30 can include a base member 32 having a broad portion 34 formed of a rigid material, while the elongate portion 35 is formed of a flexible material. According to this embodiment, the elongate portion may be attached to the broad portion using a rivet 28. Alternatively, the elongate portion can be formed integrally with the broad portion (not shown) such that the rigidity of the broad portion and flexibility of the elongate portion are obtained by increasing the thickness of the broad portion relative to the elongate portion.

Figure 2:
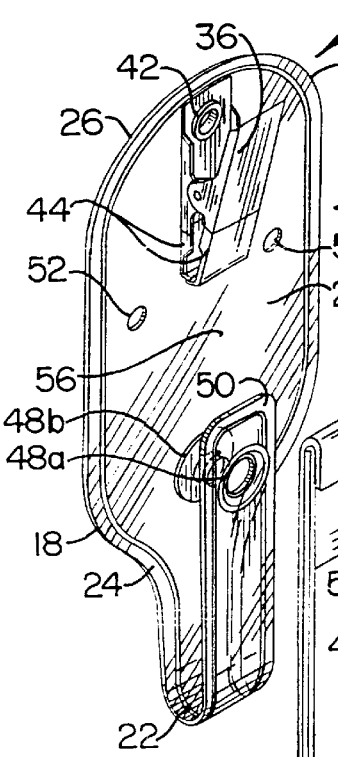
FIG. 2 is a perspective view illustrating one embodiment of an identification holder according to the present invention.
Figure 4:
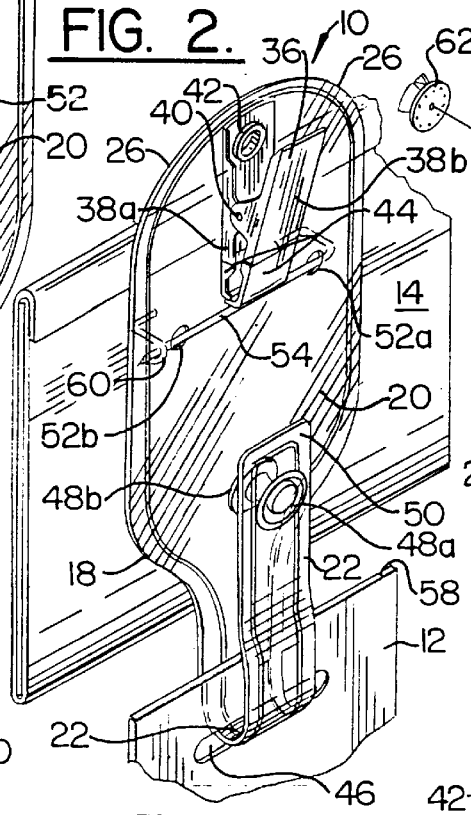
FIG. 4 is a fragmentary perspective view illustrating the identification holder of FIG. 1 securing an identification badge and an insignia.
Figure 5:
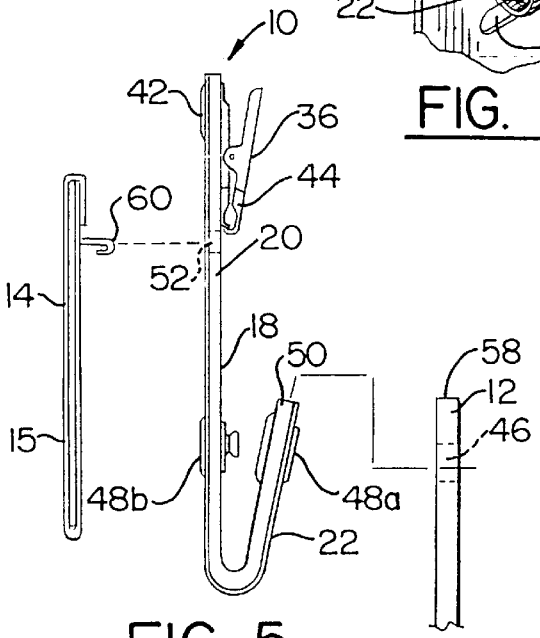
FIG. 5 is an exploded side view illustrating the identification holder of FIG. 4.

As shown in FIGS. 2 and 4, the identification holder 10 includes a clip 36 having first and second jaws 38*a,b*. The clip is attached to the broad portion 20 of the base member 18. The jaws are pivotally connected together by a centrally disposed rod 40 having an axially mounted torsion spring (not shown). The spring biases the jaws of the clip in the closed position. To open the clip, the user depresses the open end of the jaws. Preferably, the clip is rotatably attached to the base member using a rivet 42. As shown in FIGS. 4 and 5, the jaws of the clip may be coated with vinyl 44 to protect the item of clothing from damage when the identification holder is secured thereto.

As shown in FIGS. 2 and 3, the elongate portion 22 has a reduced width relative to the broad portion 20. As best shown in FIG. 5, the elongate portion is adapted to extend through the slot 46 of an identification badge 12 to thereby mount the identification badge to the elongate portion. In this regard, the identification holder includes a pair of cooperating interlocking members 48*a,b*. At least one of the interlocking members 48*a* is attached to the distal end 50 of the elongate portion and the other of the interlocking members 48*b* is attached to the base member 18 so as to cooperate and secure the identification badge 12 to the elongate portion when the elongate portion is extended through the slotted identification badge and then folded over itself and the interlocking members are fastened together, as is shown in FIG. 1. In one preferred embodiment, as is shown in FIG. 5, the interlocking member attached to the distal end of the elongate portion is a female snap member. In this embodiment, the other interlocking member attached to the base member is a male snap member.

As is shown in FIGS. 3 and 4, the broad portion 20 of the base member 18 defines at least one aperture 52 therethrough adapted and arranged to receive the pin 54 of an insignia 14 whereby the insignia is positioned proximate to the identification badge 12 for easy readability.

Advantageously, as shown in FIG. 3, the broad portion of the base member defines an insignia-positioning space 56 between the clip and the interlocking member 48*b* secured to the base member 18 such that the apertures 52 defined by the base member are positioned proximate to the upper surface 58 of the identification badge 12. Advantageously, when an identification badge is secured to the elongate portion and an insignia is secured within the insignia-positioning space, both the insignia and the identification badge are simultaneously readable.

As shown in FIGS. 3–5, the "pinned" insignia 14 have an ornamental front 15 and are secured or clasped in one of two ways. First, as shown in FIGS. 4 and 5, the insignia may include a pin 54 protruding from the back that cooperates with a hook clasp 60. For this type of insignia, commonly referred to as a convention badge, the apertures defined by the base member are horizontally spaced in the insignia-positioning space 56 defined by the broad portion 20 of the base member 18. Preferably, the apertures are spaced apart approximately ⅞" from center to center. To secure the insignia, the pin is inserted through the first aperture 52*a*, as shown in FIG. 4, and then through the second aperture 52*b* and is then secured within the hook clasp, which prevents the insignia from becoming dislodged from the identification holder 10. Advantageously, the insignia can be secured directly above a separate ID card 12 for easy and efficient viewing by an observer. Further, the convention badge secured within the insignia-positioning space will cover the snap members 48 securing the identification card, as well as the distal end 50 of the elongate portion 22, which is fashionably and aesthetically desirable.

Alternatively, as shown in FIG. 3, the insignia may include a pin 54 that is inserted through one aperture and is then prevented from exiting by a clasp 62 that is attached to the end of the pin. For this type of "pinned" insignia, the diameter of each aperture is smaller than the diameter of the clasp so that the insignia is secured to the identification holder 10. Advantageously, the horizontally spaced apertures can receive the pin of either type of "pinned" insignia, thus avoiding the necessity of inserting a pin through an item of clothing, which can result in permanent damage to the clothing.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An identification holder for securing a slotted identification badge and at least one pinned insignia to an item of clothing comprising:

a base member formed of a generally flat material defining a broad portion and an elongate portion depending therefrom when the identification holder is in use or mounted upon a support surface;

a clip attached directly to said broad portion of said base member;

said elongate portion having a reduced width relative to said broad portion and adapted to extend through the slot of an identification badge thereby mounting the identification badge to said elongate portion;

a pair of cooperating interlocking members, at least one of said interlocking members being attached to the distal end of said elongate portion and the other of said interlocking members being attached to the base member so as to cooperate and secure the identification badge to said elongate portion when said elongate portion is extended through the slotted identification badge and the interlocking members are fastened together;

said broad portion of said base member defining at least one aperture therethrough adapted and arranged to receive the pin of an insignia whereby the insignia is positioned proximate to the identification badge for easy readability.

2. An identification holder according to claim 1 wherein said broad portion of said base member defines an insignia-positioning space between said clip and said interlocking member secured to said base member such that said at least one aperture defined by said base member is positioned proximate to the upper surface of the identification badge.

3. An identification holder according to claim 2 wherein said apertures defined by said base member are horizontally spaced in the insignia-positioning space defined by said broad portion of said base member.

4. An identification holder according to claim 1 wherein said at least one aperture is arranged and positioned such that the at least one pinned insignia can cover said fastened interlocking members and at least a portion of said distal end of said elongate portion.

5. An identification holder according to claim 1 wherein said base member has rounded corners.

6. An identification holder according to claim 1 wherein said interlocking member attached to said distal end of said elongate portion is a female snap member and said other interlocking member attached to said base member is a male snap member.

7. An identification holder according to claim 1 wherein said base member is formed of a transparent material.

8. An identification holder according to claim 1 wherein said base member is formed of an opaque material.

9. An identification holder according to claim 1 wherein said base member is formed of a flexible material.

10. An identification holder according to claim 1 wherein said broad portion of said base member is formed of a rigid material.

11. An identification holder according to claim 1 wherein said base member is formed of polyvinyl chloride.

12. An identification holder according to claim 1 wherein said clip is rotatably attached to said base member.

13. An identification holder according to claim 1 wherein said clip has first and second jaws, said first and second jaws of said clip being coated with vinyl to thereby protect the item of clothing from damage.

14. An identification holder for securing a slotted identification badge and at least one pinned insignia to an item of clothing comprising:

a base member formed of a generally flat material defining a broad portion and an elongate portion depending therefrom when the identification holder is in use or mounted upon a support surface;

a clip attached directly to said broad portion of said base member;

said elongate portion having a reduced width relative to said broad portion and adapted to extend through the slot of an identification badge thereby mounting the identification badge to said elongate portion;

a pair of cooperating snap members, at least one of said snap members being attached to the distal end of said elongate portion and the other of said snap members being attached to the base member so as to cooperate and secure the identification badge to said elongate portion when said elongate portion is extended through the slotted identification badge and the snap members are snapped together;

said broad portion of said base member defining two horizontally spaced apertures therethrough adapted and arranged to receive the pin of the at least one pinned insignia whereby the at least one pinned insignia is positioned so as to cover said fastened snap members and at least a portion of said distal end of said elongate portion.

15. An identification holder according to claim 14 wherein said broad portion of said base member defines an insignia-positioning space between said clip and said interlocking member secured to said base member such that said at least one aperture defined by said base member is positioned proximate to the upper surface of the identification badge.

16. An identification holder according to claim 15 wherein said apertures defined by said base member are horizontally spaced in the insignia-positioning space defined by said broad portion of said base member.

17. An identification holder according to claim 14 wherein said base member has rounded corners.

18. An identification holder according to claim 14 wherein said interlocking member attached to said distal end of said elongate portion is a female snap member and said other interlocking member attached to said base member is a male snap member.

19. An identification holder according to claim 14 wherein said base member is formed of a transparent material.

20. An identification holder according to claim 14 wherein said base member is formed of an opaque material.

21. An identification holder according to claim 14 wherein said base member is formed of a flexible material.

22. An identification holder according to claim 14 wherein said broad portion of said base member is formed of a rigid material.

23. An identification holder according to claim 14 wherein said base member is formed of polyvinyl chloride.

24. An identification holder according to claim 14 wherein said clip is rotatably attached to said base member.

25. An identification holder according to claim 14 wherein said clip has first and second jaws, said first and second jaws of said clip being coated with vinyl to thereby protect the item of clothing from damage.

* * * * *